US006575098B2

(12) United States Patent
Hsiung

(10) Patent No.: US 6,575,098 B2
(45) Date of Patent: Jun. 10, 2003

(54) PRACTICE CARTRIDGE

(75) Inventor: Jen Chou Hsiung, Kaohsiung (TW)

(73) Assignee: The 205th Arsenal, Combined Service Forces (TW)

( * ) Notice: Subject to any disclaimer, the term of this patent is extended or adjusted under 35 U.S.C. 154(b) by 0 days.

(21) Appl. No.: 09/900,967

(22) Filed: Jul. 10, 2001

(65) Prior Publication Data

US 2002/0002925 A1 Jan. 10, 2002

(30) Foreign Application Priority Data

Jul. 10, 2000 (TW) ..... 89113732 A

(51) Int. Cl.[7] ..... F42B 8/00
(52) U.S. Cl. ..... 102/498; 102/520
(58) Field of Search ..... 102/430, 434, 102/439, 444, 445, 446, 447, 464, 520, 521, 522, 523, 530, 531, 532; 42/76.01

(56) References Cited

U.S. PATENT DOCUMENTS

| | | | | | |
|---|---|---|---|---|---|
| 3,003,418 | A | * | 10/1961 | Young | 102/436 |
| 3,408,891 | A | * | 11/1968 | Hartman | 411/441 |
| 3,991,682 | A | * | 11/1976 | Peak | 102/438 |
| 4,307,651 | A | * | 12/1981 | Batson et al. | 89/1.808 |
| 4,476,785 | A | * | 10/1984 | Hoffman et al. | 102/522 |
| 4,686,905 | A | | 8/1987 | Szabo | |
| 4,756,255 | A | * | 7/1988 | Rosneberg et al. | 102/521 |
| 4,938,145 | A | * | 7/1990 | Martwick | 102/434 |
| 5,016,536 | A | | 5/1991 | Brighton | |
| 5,090,328 | A | * | 2/1992 | Theis et al. | 102/522 |
| 5,130,207 | A | * | 7/1992 | Nelson | 428/577 |
| 5,359,937 | A | | 11/1994 | Dittrich | |
| 5,492,063 | A | * | 2/1996 | Dittrich | 102/430 |
| 5,712,445 | A | * | 1/1998 | Kassuelke et al. | 102/288 |
| 5,880,397 | A | * | 3/1999 | Crilly | 102/443 |
| 6,095,051 | A | * | 8/2000 | Saxby | 102/444 |
| 6,293,203 | B1 | * | 9/2001 | Alexander et al. | 102/430 |
| 6,422,149 | B1 | * | 7/2002 | Saxby | 102/446 |
| 6,439,123 | B1 | * | 8/2002 | Dionne et al. | 102/430 |

FOREIGN PATENT DOCUMENTS

| | | | | |
|---|---|---|---|---|
| DE | 4128050 | * | 2/1993 | 102/444 |

* cited by examiner

*Primary Examiner*—Peter M. Poon
*Assistant Examiner*—David J Parsley

(57) ABSTRACT

A cartridge assembly for military and police training meets the requirement of practicing vividly while causing no harm. The assembly mainly has a projectile, a sabot, a C-type ring, and a cartridge case, wherein the projectile is disposed in a recess of the sabot; the sabot is fitted tightly into the case and the C-type ring is disposed in a slot at the bottom of the sabot. Upon a primer being struck to ignite the powder, the expanding gas partially outbursts and bleeds through an orifice to propel the projectile while the other part of the energy is applied to eject the cartridge case. As the cartridge case is pulled back, the elasticity of the C-type ring results in engagement of the sabot and the cartridge case, so as to achieve the aim of the ballistic cycle of the ammunition.

20 Claims, 4 Drawing Sheets

PRACTICE CARTRIDGE

BACKGROUND OF THE INVENTION

1. Field of the Invention

This invention relates to the field of ammunition, more specifically, to non-lethal ammunition used in training and war games that could also be used in automatic and semi-automatic firearms.

2. Description of the Related Art

There has long existed the need for firing practice of automatic and semi-automatic firearms. As automatic firearms are used by more and more organizations such as the military and police, the need for an effective practice has grown urgently. The ideal practice round for automatic and semi-automatic weapons incorporates the functions of firing a non-lethal projectile to mark the impact point, satisfactorily actuating the automatic ejection of the spent casing, functioning in a standard firearm with a minimum modification, and being relatively inexpensive.

The primary problem that has existed in using automatic or semi-automatic firearms is the providing of enough "kickback" without raising the muzzle velocity or impact force of the projectile. Usually with practice or non-lethal rounds it is important to maintain lower muzzle velocities and keep weight, and therefore to reduce the inertia of the projectile, at a minimum. However, under such circumstances, usually such rounds have not provided enough back force for automatic ejection mechanism for proper actuation.

Practice firearms nowadays being used involve those utilizing a laser, $CO_2$ actuation or blanks. Obviously, the laser type devices are expensive, somewhat cumbersome, and usually are not conventional in operation. $CO_2$ type practice devices are sometimes actuating a capsule type of cartridge with high-pressurized gas and are usually not conventional in operation. The firing of blanks obviously involves no projectile to mark the point of impact and thus are unable to offer the advantage of the conventional firearms during practice.

However, during the ballistic cycle of ammunition, the operation of conventional automatic and semi-automatic firearms are actuated either by the expansion of propellant gas against a sabot connected to the recoiling bolt or by direct blowback of the cartridge case against the bolt upon expansion of the propellant gas. In these systems, the energy provided to the recoil mechanism is related to that imparted to the projectile. That is, a reduced pressure in the chamber or variations in weight of the projectile will result in variation of the total energy given to the firearm-operating mechanism which, in turn, will affect its cyclic rate or the reliability of its operation. With low-mass projectiles or the type used in training and non-lethal cartridge, the problem is especially severe. Frangible projectiles may not be capable of withstanding high accelerations. The low energy required for launch of these lightweight projectiles may not produce a sufficient reaction or necessitate a high enough chamber pressure to cycle conventional firearm mechanisms. Blank cartridge, that is, a cartridge without a projectile, will not normally be able to automatically cycle ejection without a muzzle adapter to increase the pressure in the system sufficiently to make the mechanism function.

The above mentioned problem may also be observed in larger caliber guns, such as 40 mm grenade launchers, where a relatively low-velocity projectile with limited capacity to withstand high accelerations, is launched from an automatic gas-operated firearms. To overcome such problems, the "high-low" ballistic system is adopted. Propellant in the "high-low" ballistic system is initially burned in a high-pressure section of a partitioned cartridge case and released through orifices into the side containing the projectile at a rate sufficient to limit the peak pressure or acceleration on the projectile. Such a system is described in U.S. Pat. No. 4,686,905. While such system can provide reduced peak forces available for firearm function, necessitating design compromises in the firearm.

U.S. Pat. No. 5,359,937 entitled "Reduced Energy Cartridge", issued to Dittrich on Nov. 1, 1994, disclosed a cartridge for low-mass, frangible projectile which comprises a sabot to propel against an inner shoulder of a chamber. The cartridge has a sabot with an orifice applied to lead the propellant gas from the rear of a sabot to the rear of a projectile in order to eject the projectile under controlled impact force. The wall of the cartridge case has an inwardly extended flange and the bottom of the sabot has an outward step. Upon percussion, the cartridge case is pushed backward opposite the sabot by expansion of propellant gas and the step of the sabot is engaged with the flange of the case to engage the cartridge case together with the sabot, thus enables the spent sabot and the cartridge case to eject together. However, during assembly, because the outer diameter of the step of the sabot is larger than the inner diameter of the flange of the case, the sabot is unable to be inserted into the case directly. Other than extra finishing process, material with good malleability, such as copper is necessary for the cartridge case in order to insert the sabot smoothly into the case during assembling.

SUMMARY OF THE INVENTION

It is the primary object of the present invention to provide a practice cartridge which can launch a low-mass, frangible, non-lethal or low energy projectile and the cartridge can be produced efficiently and the material is not limited to conventional copper material, hence to reduce the production cost.

It is still another object of the present invention to provide a practice cartridge which can launch a low-mass, frangible, non-lethal or low energy projectile and the cartridge can be used in existing semi-automatic and automatic firearms to maintain their reliability of cycling mechanism in semi-automatic and automatic firearms.

The above-mentioned objects of the invention are achieved by the provision of a cartridge used in existing firearms, such as semi-automatic and automatic firearms, to launch a low-energy projectile. The cartridge comprises a cartridge case having a rear-end portion and a front-end portion, the front-end portion defining an inner diameter and its inner side-wall having an inclined groove; a primer disposed in the bottom of the cartridge case; a sabot comprising a front-end portion with a greater diameter and a rear-end portion with a smaller diameter, the rear-end portion having a substantially occlude end, wherein the outer diameter of the rear-end portion is substantially the same as the inner diameter of the inner wall of the cartridge case fitted hermetically into the cartridge case forming a hermetic space therein, and the outside of the rear-end portion is provided with a groove. The front-end portion of the sabot may be propelled against the shoulder of the chamber and the rear-end portion has at least an orifice to connect the hermetic space to the front-end portion allowing the propellant gas within the hermetic space bleed to the front-end portion through the orifice. Also a limiting element is disposed in the groove of the sabot. Upon percussion, as the inclined groove of the cartridge case slides towards the limiting element, due to the elasticity, the limiting element returns to its uncompressed state and engages with the inclined groove of the cartridge case, thereby limiting the further movement of the cartridge case relative to the sabot.

According to the cartridge of the present invention, during assembly, the limiting element disposed in the groove of the sabot is fitted into the cartridge case. As the limiting element passes through the inclined groove in the cartridge case, it extends into the inclined groove due to the elasticity. However, as the inclined groove has an inwardly inclined surface, the limiting element can be compressed into the groove by the inclined surface. Thus the sabot can further enter into the cartridge case until the step of the sabot is propelled against the cartridge case. Therefore, the cartridge of the invention can overcome the limitation on manufacture and materials described on U.S. Pat. No. 5,359,937.

Upon percussion, the propellant gas bursts from the hermetic space through the orifice to the rear-end portion of the projectile to eject the projectile. The front-end portion of the sabot is propelled against the shoulder of the chamber, therefore the cartridge case is pushed backward by the expanded gas generated from the powder. As the inclined groove of the cartridge case slides toward the limiting element, due to the elasticity, the limiting element returns to its uncompressed state and engages with the inclined groove of the cartridge case. Thereby it limits the further movement of the cartridge case relative to the sabot to ensure the spent sabot and the cartridge case to be ejected together in order to achieve the aim of cycling the automatic and semi-automatic firearms.

BRIEF DESCRIPTION OF THE DRAWINGS

Other objects, advantages, and novel features of the invention will become more apparent from the following detailed description when taken in conjunction with the accompanying drawings.

DETAILED DESCRIPTION OF THE PREFERRED EMBODIMENT

Figures 1, 2:
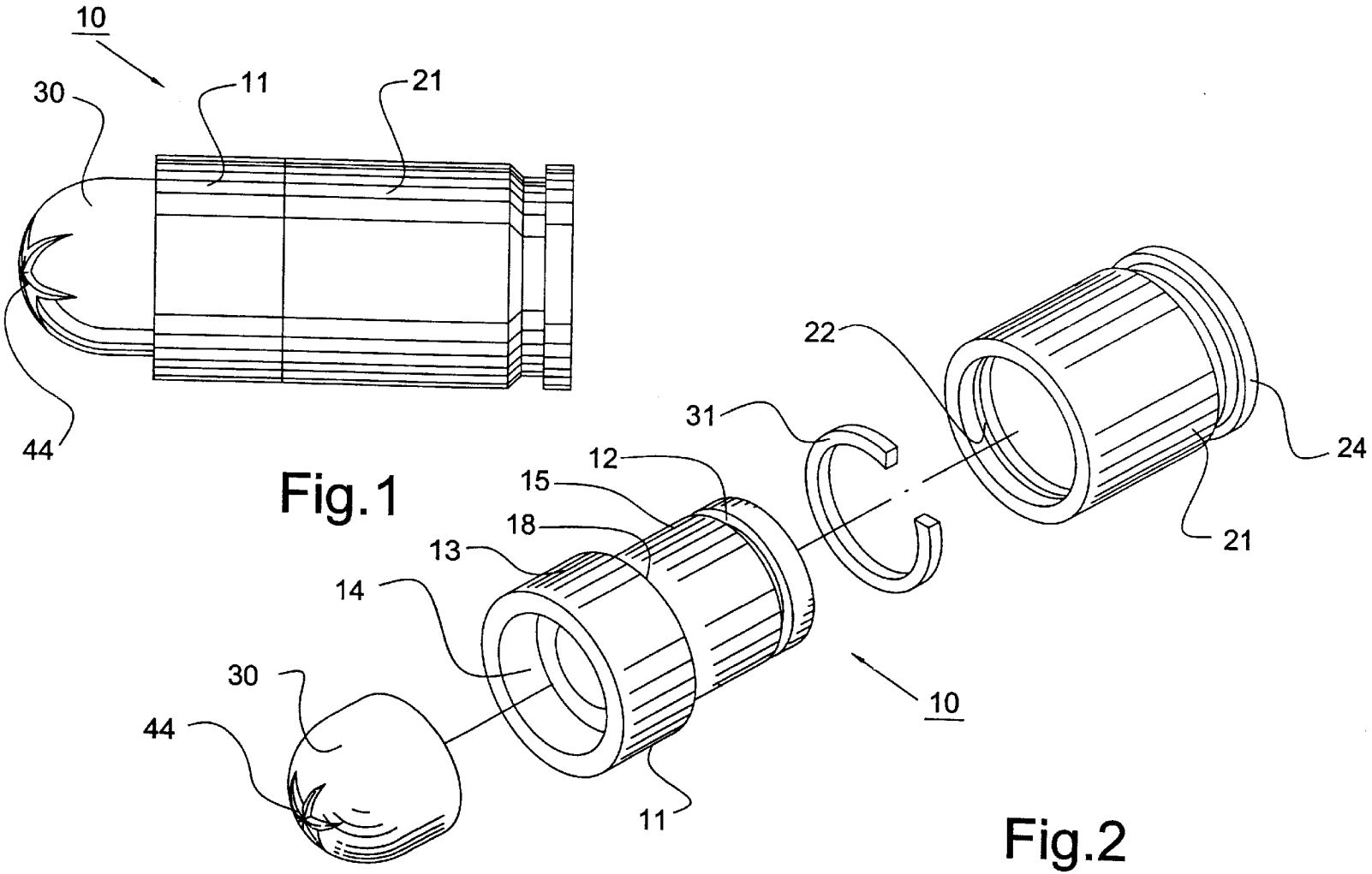
FIG. 1 is a perspective view of a cartridge in accordance with a first embodiment of the invention.
FIG. 2 is an exploded view of a cartridge in accordance with a first embodiment of the invention.

A first embodiment of a cartridge 10 in accordance with the present invention is depicted generally in FIGS. 1 and 2. The cartridge 10 can be used in conventional firearms, such as semi-automatic and automatic firearms. The cartridge 10 mainly comprises a cartridge case 21, a sabot 11 disposed in the cartridge case 21, and a projectile 30 fitted tightly within the front-end portion of the sabot 11. A limiting element 31, which is preferable a C-type ring, is disposed between the cartridge case 21 and the sabot 11 of the cartridge 10.

Figure 3:
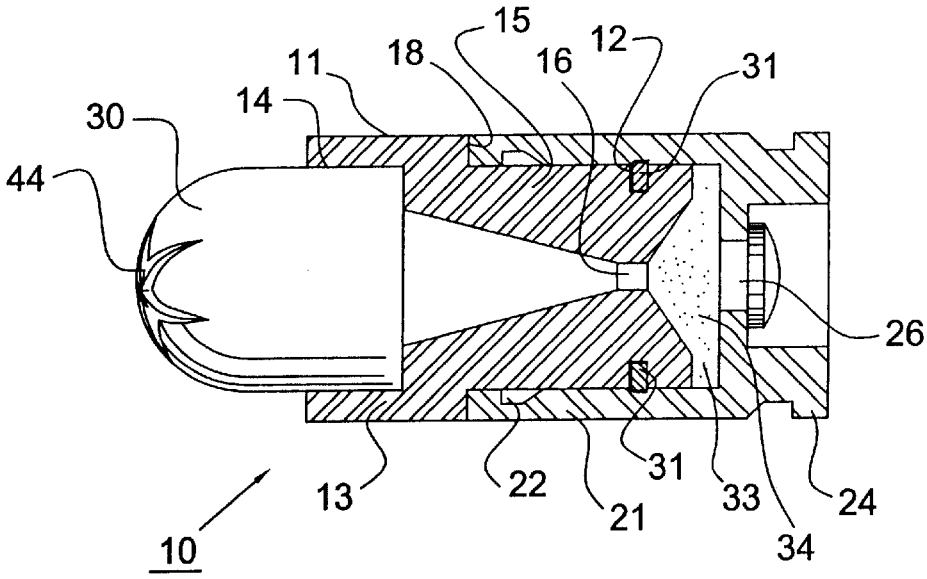
FIG. 3 is a cross sectional view of a cartridge in accordance with a first embodiment of the invention.

FIG. 3 illustrates the cross sectional view of the cartridge 10. The cartridge case 21 is a substantially hollow cylindrical body having a primer 26 disposed at the bottom of the cartridge case 21 which provides ignition and/or propulsion energy. A flange 24 at the end of the cartridge case 21 is used to engage with a recoil mechanism to eject the cartridge 10 after percussion. An annular inclined groove 22 is formed at the inner wall of the front-end portion of the cartridge case 21.

The sabot 11 of the cartridge 10 has a front-end portion 13 with a larger diameter and a rear-end portion 15 with a smaller diameter, between which a step 18 is formed. The bottom of the rear-end portion 15 with a smaller diameter is substantially closed; its outer diameter is substantially the same as the inner diameter of the cartridge 21 to be fitted tightly into the hollow cylindrical inner wall of the cartridge 21. A groove 12 is formed on the outer wall of the rear-end portion 15 of the sabot 11. After the sabot 11 is inserted to the cartridge case 21, a hermetic space 33 for loading powder 34 is formed between the rear-end portion 15 of the sabot 11 and the bottom of the cartridge case 21. The outer diameter of the front-end portion 13 is substantially the same as the outer diameter of cartridge case 21. The front-end portion 13 comprises a recess 14 for receiving a projectile 30. The rear-end portion 15 of the sabot 11 has at least an orifice 16 to connect the hermetic space 33 to the rear of the projectile 30 allowing the propellant gas within the hermetic space 33 bleed to the projectile 30 through the orifice 16.

As the cartridge 10 of the present invention is assembled, the limiting element 31, preferably a C-type ring, is disposed in the groove 12 of the sabot 11 and corporately fitted into the cartridge case 21. As the limiting element 31 passes through the inclined groove 22 of the cartridge case 21, it expands outwards and slides into the inclined groove 22 due to the elasticity. However, as the inclined groove 22 has an inwardly inclined surface, the limiting element 31 can be compressed into the groove 12 by the inclined surface. Thus, the sabot 11 can further enter into the cartridge case 21 until the step 18 of the sabot 11 is propelled against the cartridge case 21.

The cartridge 10 may be stored for a long duration after manufacture. The inner wall of the cartridge case 21 preferably has a slot 28 corresponding to the limiting element 31. When the sabot 11 is tightly fitted in the cartridge case 21, the limiting element 31 may expand slightly to fit into the slot 28 to preserve its elasticity. After long-term storage, the limiting element 31 of the cartridge 10 will not lose its elasticity caused by long-term elastic fatigue so as not to limit the further travel of sabot 11 opposite to the cartridge case 21 after percussion (described thereinafter).

Figure 4:
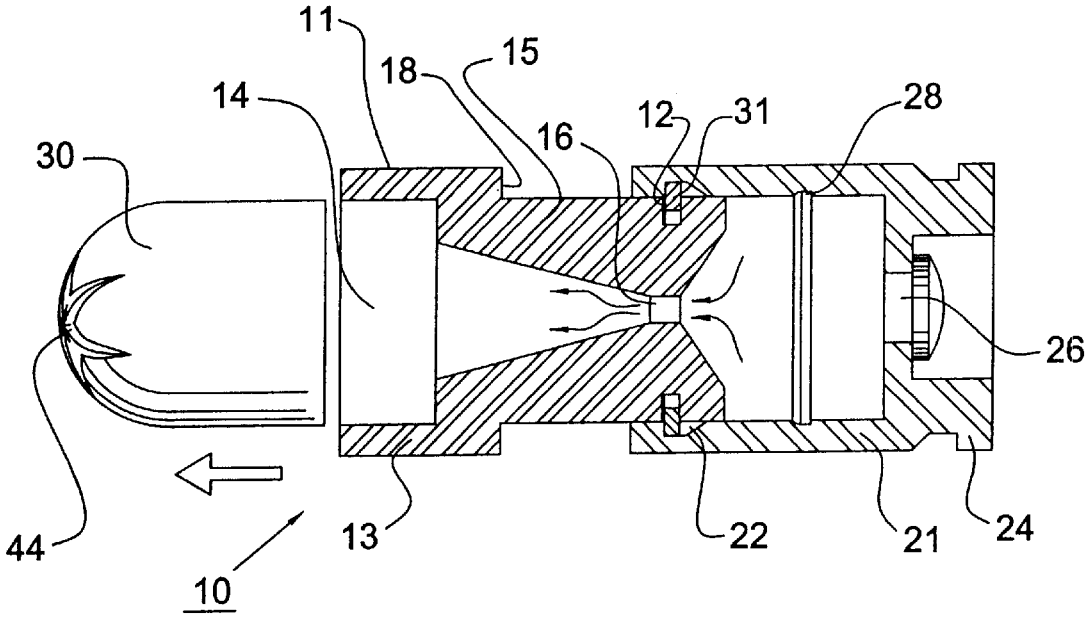
FIG. 4 is a cross sectional view of a cartridge after percussion in accordance with a first embodiment of the invention.

In FIG. 4, when the cartridge 10 is being operated, i.e., upon the primer 26 being ignited to induce the expansion of the powder 34, the propellant gas outbursts from the hermetic space 33 through the orifice 16 to the rear-end portion of the projectile 30, thereby ejecting the projectile 30 (as the arrows point in FIG. 4). The desired energy for ejecting the projectile 30 may be obtained by adjusting the amount and the size of the orifice(s) 16. The front-end portion 13 of the sabot 11 is propelled against the shoulder (not shown in the drawings) inside the chamber, therefore the cartridge case 21 is moved backward by the expanded gas produced from powder 34. As the inclined groove 22 of the sabot 11 slides to the limiting element 31, the compressed limiting element 31 returns to its uncompressed state due to the elasticity and is engaged with the inclined groove 22 of the cartridge case 21, thereby limiting the further movement of the cartridge 21 relative to the sabot 11. The front-end of the sabot 11 is propelled against the shoulder of the chamber of automatic or semi-automatic firearms (not shown in drawings) and by the backward movement of the cartridge case 21, the flange 24 of the cartridge case 21 is engaged with a recoil mechanism. Thus it enables the sabot 11 of the cartridge 10 and the cartridge case 21 to be ejected together to cycle the automatic and semi-automatic firearms.

As mentioned above, the projectile 30 of the cartridge 10 of the present invention does not effect the cycle of automatic and semi-automatic firearms. Therefore the projectile 30 can be made of multiple materials and made in multiple forms. For example, the projectile 30 may be a hollow plastic capsule with a pre-cracked notch 44 on top surface, which is filled with a marking dye, a tear gas substance or the like. As the projectile 30 hits a target, the projectile 30 may be broken easily from the pre-cracked-notch 44 and release the filled substance to achieve the functions such as marking the impact point. Further, when the cartridge 10 is blank, i.e., the cartridge 10 has no projectile 30, the propellant gas escapes from a muzzle, producing the flash and noise and reinforcing the effect of the blank. However, it does not influence the cycle of automatic and semi-automatic firearms.

Figure 5:
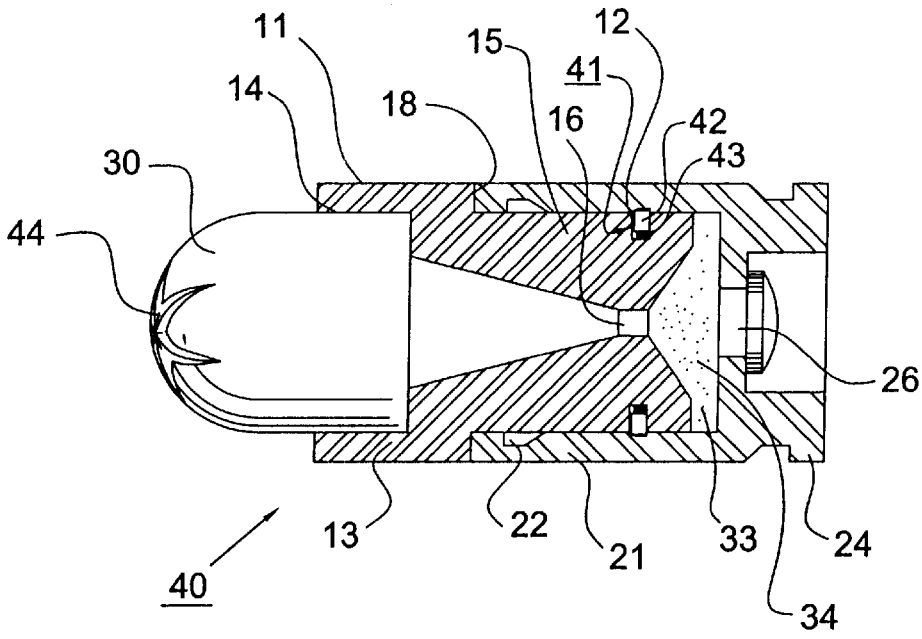
FIG. 5 is a cross sectional view of a cartridge in accordance with a second embodiment of the invention.
Figure 6:
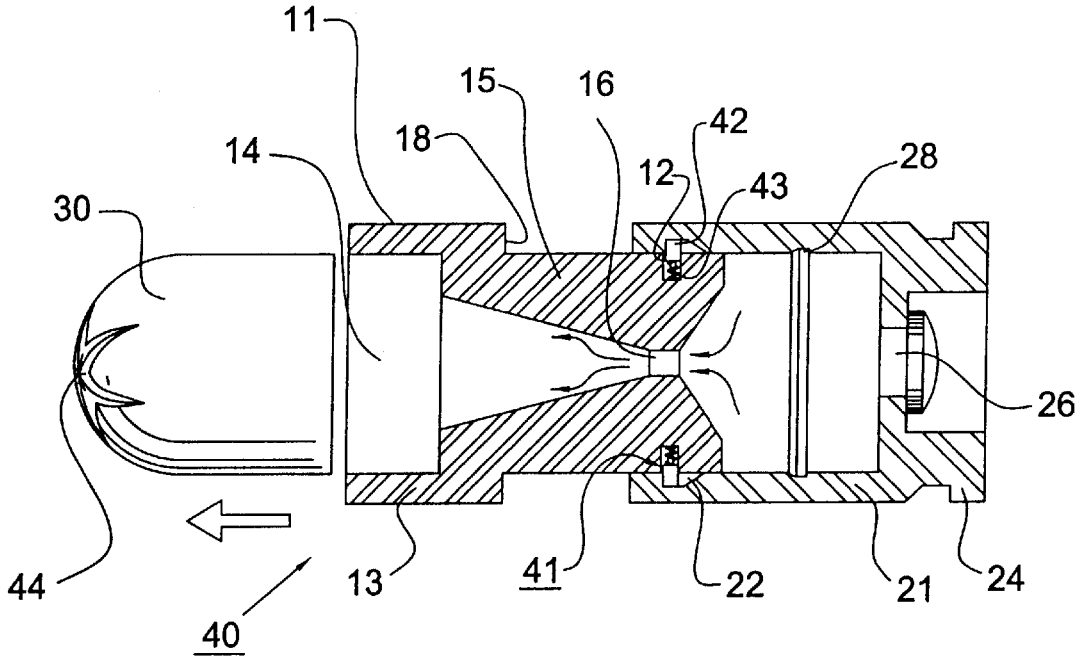
FIG. 6 is a cross sectional view of a cartridge after percussion in accordance with a second embodiment of the invention.

The cartridge 40 of the second embodiment of the invention is shown in FIG. 5 and FIG. 6. The mechanism of the cartridge 40 is substantially similar to that of the cartridge 10, wherein like reference numerals refer to like elements. The difference between the cartridge 10 and the cartridge 40 is the construction of the limiting element 41 of the present embodiment.

According to the cartridge 40 of the present embodiment, the sabot 11 has at least two grooves 12 at the outside of the rear-end portion 15. A limiting element 41 includes a pin 42 and a compressed spring 43. The pin 42 and the compressed spring 43 are disposed respectively into the recess of the sabot 11. When the cartridge of the present invention is assembled, as the pin 42 and compressed spring 43 pass through the inclined groove 22 of the cartridge case 21, the pin 42 extends into the inclined groove 22 forced by the compressed spring 43. However, as the inclined groove has an inwardly inclined surface, the pin 42 can be compressed into the groove 12 by the inclined surface. Thus the sabot 11 can further enter into the cartridge case 21 till the sabot 11 is propelled against the cartridge case 21. The inner wall of the cartridge 21, preferably, further comprises a slot 28 corresponding to the pin 42. When the sabot 11 is tightly fitted in the cartridge case 21, the pin 42 may expand slightly into the slot 28 to preserve the elasticity of the spring 43.

In FIG. 6, when the cartridge 40 is being operated, i.e., upon the primer 26 being ignited to induced the expansion of the powder 34, the propellant gas outbursts from the hermetic space 33 through the orifice 16 to the rear portion of the projectile 30 to eject the projectile 30 (as the arrows point in FIG. 6). The front-end portion 13 of the sabot 11 is propelled against the shoulder (not shown in drawings); therefore, the cartridge case 21 is pushed backward by the expanded gas produced from the powder 34. As the inclined groove 22 of the sabot 11 slides to the pin 42, the compressed spring 43 returns to its uncompressed state due to the elasticity and is engaged with the inclined groove 22 of the cartridge case. Therefore, it limits the movement of the cartridge case 21 relative to the sabot 11. The sabot 11 is propelled against the shoulder inside the chamber of automatic or semi-automatic firearms (not shown in drawings); the flange 24 of the cartridge case 21 is engaged with a recoil mechanism by the backward movement of the cartridge case 21. Thus it enables to eject the spent sabot 11 of the cartridge and cartridge case 21 together and to cycle the automatic and semi-automatic firearms.

Figure 7:
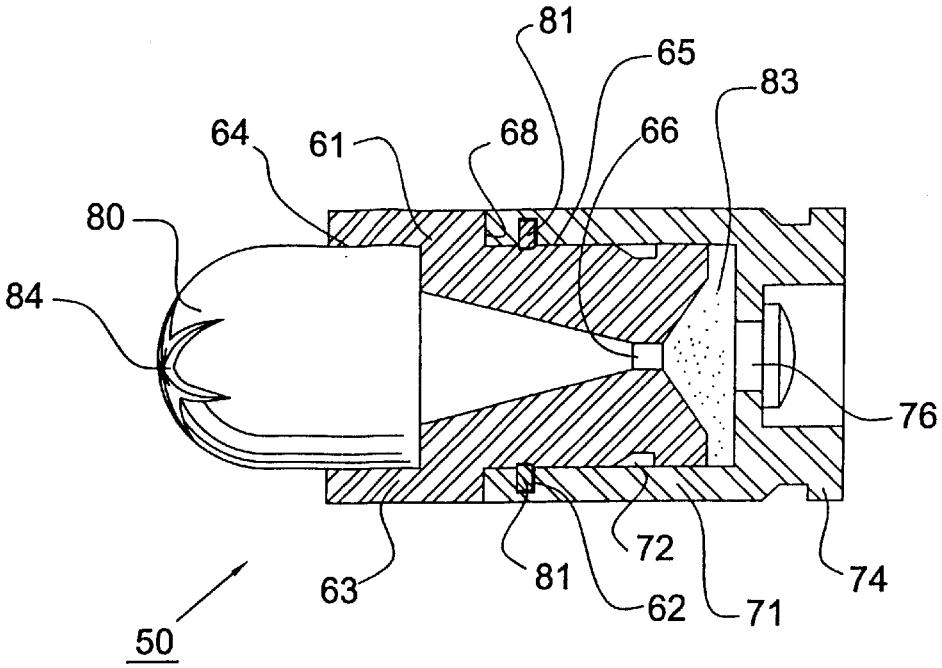
FIG. 7 is a cross sectional view of a cartridge in accordance with a third embodiment of the invention.
Figure 8:
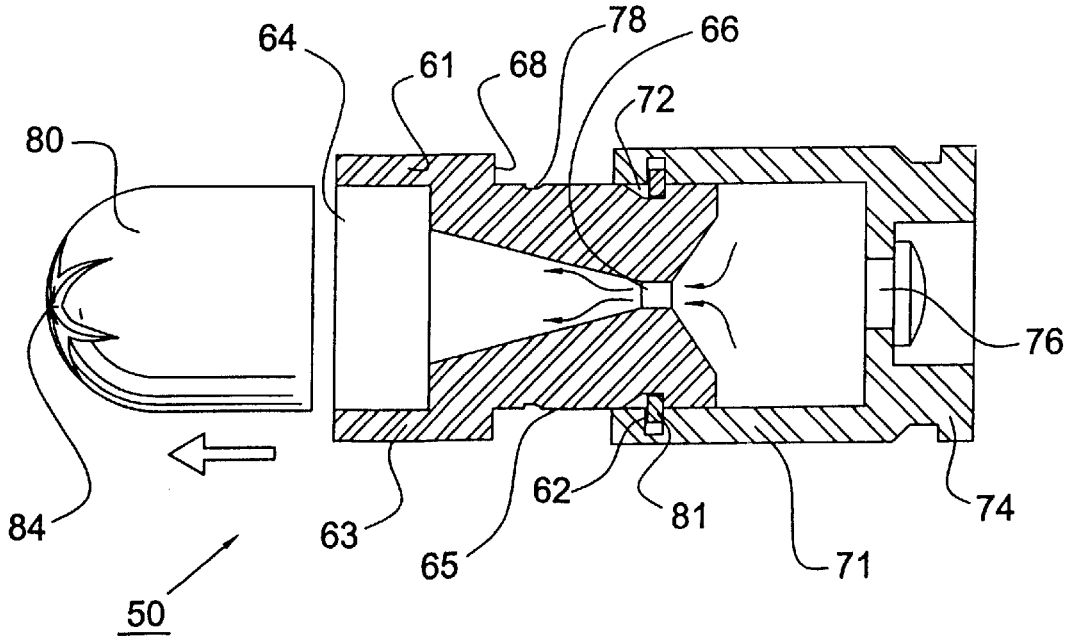
FIG. 8 is a cross sectional view of a cartridge after percussion in accordance with a third embodiment of the invention.

The cartridge 50 of the third embodiment of the invention is shown in FIGS. 7 and 8. The mechanism of the cartridge 50 is substantially similar to that of the cartridge 10, wherein like reference numerals refer to like elements.

The difference between the cartridge 10 and the cartridge 50 is that the inclined groove 72 is disposed at the end of the sabot 61 and the cartridge case 71 comprises a corresponding groove 62. Similar to the operation of the cartridge 10 of the above-mentioned embodiments, the limiting element 81 is disposed, during manufacture, into the inclined groove 72 of the sabot 61 and compressed, then fitted corporately into the cartridge case 71, and then expands into the groove 62. Thus the limiting element 81 is disposed into the groove 62 and compressed by the inclined surface of the inclined groove 72. Therefore, the sabot 61 further is fitted into the cartridge case 71. Alternatively, the sabot 61 also may have another slot 78 to contract the limiting element to preserve the elasticity of the limiting element 81 and to limit the movement of the cartridge case 71 relative to the sabot 61 after percussion.

In FIG. 8, when the cartridge 50 is in operation, i.e., upon the primer 76 ignited to induce the expansion of the powder, the propellant gas outbursts from the hermetic space 83 through the orifice 66 to the rear of the projectile 80 to eject the projectile 80 (as the arrows point in FIG. 8). Further, the cartridge case 71 also is pushed backward by the expanded gas produced from the powder. As the cartridge case 71 and the limiting element 81 slide backward through the inclined groove 72 of the sabot 61, the limiting element 81 returns to its non-contracted state due to the elasticity and is engaged with the inclined groove 72 of the sabot 61. Therefore, it limits the further movement of the cartridge case 71 relative to sabot 61. The sabot 61 is propelled against the shoulder of chamber of automatic or semi-automatic firearms (not shown in drawings); the flange 74 of the cartridge case 71 is engaged with a recoil mechanism by the backward movement of the cartridge case 71. Thus it enables to eject the spent cartridge 50 to cycle the automatic and semi-automatic firearms. Similarly, in accordance with this embodiment of the present invention, the cartridge 50 also may be in blank form or its projectile 80 may be a hollow plastic capsule with a pre-cracked-notch 84 on top surface, which is filled with a marking dye or the like to achieve the functions such as marking the impact point.

According to the above illustration, the cartridge case in accordance with the present invention does not need complicate processes for malleablization and deformation, it can be made of materials with less malleability, such as aluminum, iron, plastic material, or composite materials.

Therefore, the cartridge of the present invention may not only maintain the reliability of firearm-cycling mechanism of automatic and semi-automatic, the cartridge can also be made easily, thus this invention overcomes the limitation on manufacturing and material which is disclosed in U.S. Pat. No. 5,359,937.

Although the invention has been explained in relation to its preferred embodiment, it is to be understood that many other possible modifications and variations can be made without departing from the spirit and scope of the invention as hereinafter claimed.

What is claimed is:

1. A practice cartridge for use in a firearm, the firearm having a chamber defining a shoulder and a recoil mechanism, the cartridge comprising:

a cartridge case having a bottom portion and a front-end portion with an inner diameter and an inclined groove formed on the inner wall of the cartridge case;

a primer disposed in the bottom portion of the cartridge case;

a sabot having a front-end portion with a larger diameter and a rear-end portion with a smaller diameter, the rear-end portion having a substantially closed bottom, wherein the outer diameter of the rear-end portion is substantially the same as the inner diameter of the inner wall of the cartridge case to allow the rear-end portion to fit hermetically into the case and form a substantially hermetic space with the bottom of the cartridge case, a groove is formed on the outer surface of the rear-end portion of the sabot, the front-end portion of the sabot is adapted to be propelled against the shoulder of the chamber, and the rear-end portion of the sabot has an orifice communicating the hermetic space with the front-end portion allowing a propellant gas trapped within the hermetic space to bleed through to the front-end portion; and an elastic limiting element disposed in the groove of the sabot, wherein, upon percussion, the cartridge case slides relative to the sabot moving the inclined groove of the cartridge case towards the limiting element, when the inclined groove arrives at the limiting element, the limiting element expands outwardly due to the elasticity engaging with the inclined groove of the cartridge case, thereby limiting the movement of the cartridge case relative to the sabot.

2. A practice cartridge as claimed in claim 1, wherein the inner wall of the cartridge case has a slot corresponding to the limiting element to preserve the elasticity of the limiting element.

3. A practice cartridge as claimed in claim 1, wherein the front-end portion of the sabot has a recess to receive a projectile.

4. A practice cartridge as claimed in claim 1, wherein the bottom of the cartridge case has a flange to engage with a recoil mechanism to eject the cartridge case after percussion.

5. A practice cartridge as claimed in claim 1, wherein the limiting element is a C-type ring.

6. A practice cartridge as claimed in claim 1, wherein the limiting element comprises a pin and a compressed spring disposed in the grooves of the sabot respectively.

7. A practice cartridge as claimed in claim 1, further comprising a projectile which is a hollow capsule with a pre-cracked notch on the top surface and is filled with materials selected from the group consisting of a marking dye and a tear gas substance.

8. A practice cartridge as claimed in claim 1, wherein the cartridge case is made of material with less malleability than copper.

9. A practice cartridge as claimed in claim 1, wherein the cartridge case is made of a material selected from the group consisting of metallic materials, aluminum, iron, plastic materials and composite materials thereof.

10. A practice cartridge as claimed in claim 1, wherein the orifice initially is sealed but starts to open after the cartridge case moves backward.

11. A practice cartridge for use in a firearm, the firearm having a chamber defining a shoulder and a recoil mechanism, the cartridge comprising:

a cartridge case having a bottom portion and a front-end portion with an inner diameter and a groove formed on the inner wall of the cartridge case;

a primer disposed in a bottom portion of the cartridge case;

a sabot having a front-end portion with a larger diameter and a rear-end portion with a smaller diameter, the rear-end portion having a substantially closed bottom, wherein the outer diameter of the rear-end portion is substantially the same as the inner diameter of the inner wall of the cartridge case to allow the rear-end portion to hermetically fit into the case and form a substantially hermetic space with the bottom of the cartridge case, an inclined groove is formed on the outer surface of the rear-end portion of the sabot, the front-end portion of the sabot is adapted to be propelled against the shoulder of the chamber, and the rear-end portion of the sabot has an orifice communicating the hermetic space with the front-end portion allowing a propellant gas trapped within the hermetic space to bleed through to the front-end portion; and an elastic limiting element disposed in the groove of the cartridge case, wherein, upon percussion, the cartridge case slides relative to the sabot moving the limiting element towards the inclined groove of the sabot, when the limiting element arrives at the inclined groove, the limiting element expands outwardly due to the elasticity engaging with the inclined groove of the sabot, thereby limiting the movement of the cartridge case relative to the sabot.

12. A practice cartridge as claimed in claim 11, wherein the outer wall of the sabot has a slot corresponding to the limiting element to preserve the elasticity of the limiting element.

13. A practice cartridge as claimed in claim 11, wherein the front-end portion of the sabot has a recess to receive a projectile.

14. A practice cartridge as claimed in claim 11, wherein the bottom of the cartridge case has a flange to engage with the recoil mechanism to eject the cartridge case after percussion.

15. A practice cartridge as claimed in claim 11, wherein the limiting element is a C-type ring.

16. A practice cartridge as claimed in claim 11, wherein the limiting element comprises a pin and a compressed spring disposed in the groove of the sabot respectively.

17. A practice cartridge as claimed in claim 11, further comprising a projectile which is a hollow capsule with a pre-cracked notch on the top surface and is filled with materials selected from the group consisting of a marking dye and a tear gas substance.

18. A practice cartridge as claimed in claim 11, wherein the cartridge case is made of material with less malleability than copper.

19. A practice cartridge as claimed in claim 11, wherein the cartridge case is made of a material selected from the group consisting of metallic materials, aluminum, iron, plastic materials and composite materials thereof.

20. A practice cartridge as claimed in claim 11, wherein the orifice initially is sealed but starts to open after the cartridge case moves backward.

* * * * *